United States Patent [19]

Zodrow et al.

[11] Patent Number: 4,944,830

[45] Date of Patent: Jul. 31, 1990

[54] MACHINE FOR LABELLING BOTTLES

[75] Inventors: Rudolf Zodrow, Düsseldorf; Wolfgang Rogall, Wuppertal; Egon Höveler, Haan; Rainer Buchholz, Düsseldorf, all of Fed. Rep. of Germany

[73] Assignee: Holstein und Kappert AG, Dortmund, Fed. Rep. of Germany

[21] Appl. No.: 197,653

[22] Filed: May 23, 1988

[30] Foreign Application Priority Data

May 23, 1987 [DE] Fed. Rep. of Germany ..... 3717463
Mar. 3, 1988 [DE] Fed. Rep. of Germany ..... 3806919

[51] Int. Cl.[5] ..... B65C 9/02

[52] U.S. Cl. ..... 156/567; 156/DIG. 25; 156/DIG. 26; 198/631; 198/688.1; B65C/9/02

[58] Field of Search ..... 156/567, DIG. 25, DIG. 26, 156/456, 458, DIG. 12; 198/631, 688.1, 590.2, 803.01

[56] References Cited

U.S. PATENT DOCUMENTS

| | | | |
|---|---|---|---|
| 4,143,754 | 3/1979 | Eldred | 156/567 |
| 4,275,807 | 6/1981 | Mohn et al. | 156/DIG. 26 |
| 4,283,245 | 8/1981 | Benoit | 156/476 |
| 4,306,926 | 12/1981 | Pfulb | 156/215 |
| 4,430,141 | 2/1984 | Zodrow | 156/360 |
| 4,445,961 | 5/1984 | Kronseder et al. | 156/364 |
| 4,487,650 | 12/1984 | Mohn et al. | 156/567 |
| 4,512,842 | 4/1985 | Schneider | 156/357 |
| 4,693,050 | 9/1987 | Höveler | 53/137 |

FOREIGN PATENT DOCUMENTS

| | | |
|---|---|---|
| 1761059 | 4/1971 | Fed. Rep. of Germany . |
| 3514239 | 4/1985 | Fed. Rep. of Germany . |

*Primary Examiner*—Michael Wityshyn
*Attorney, Agent, or Firm*—Nils H. Ljungman

[57] ABSTRACT

This invention relates to a labelling machine for bottles which includes a bottle feeding mechanism to feed the bottles to a revolving bottle support platform. The support platform directs bottles to a labelling mechanism and an application mechanism prior to their removal by a bottle withdrawing mechanism. The bottles are maintained against undesired rotation on the support platform by axial force on the top of each bottle to produce frictional contact between the bottom of each bottle and an elastic support plate for each bottle turntable on the revolving bottle support platform. The support plate includes an elastic body and several block-shaped friction bodies imbedded therein and distributed over its surface. The friction bodies have exposed contact surfaces, which lie in the plane of the exposed surface 13 of the elastic material. Such a support plate includes a long service life and capable of providing a high degree of friction between the micro-cracked bottom of a bottle and the friction bodies.

18 Claims, 3 Drawing Sheets

Fig.2
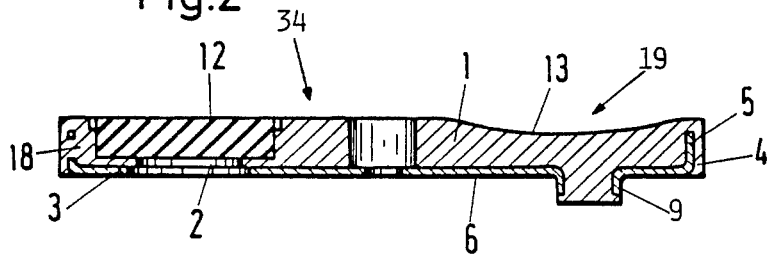
Fig.1
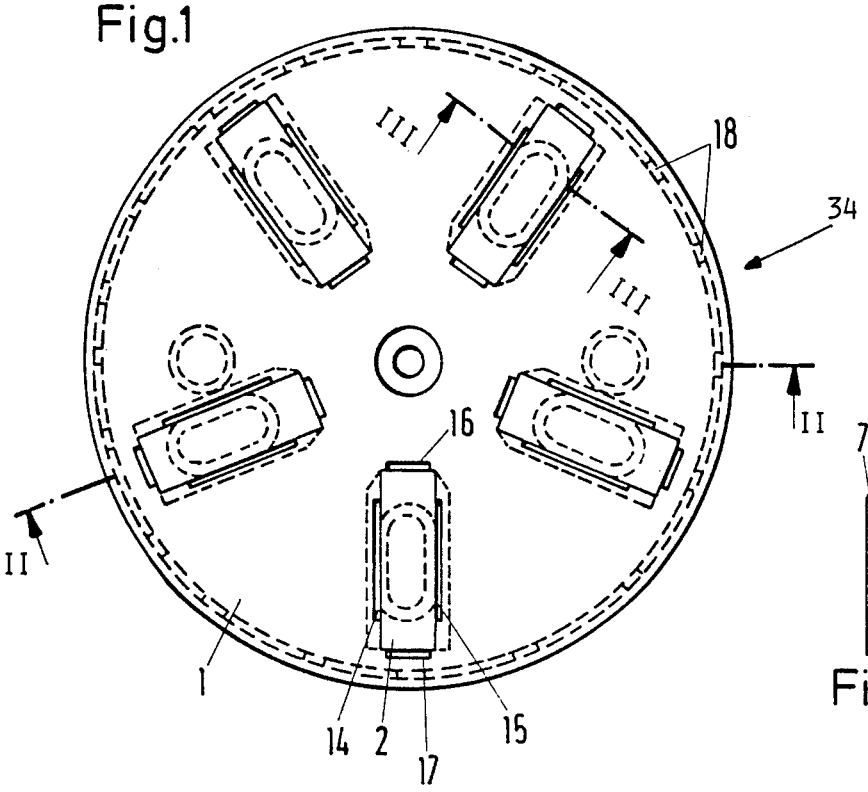
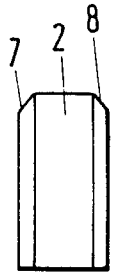
Fig.4
Fig.3
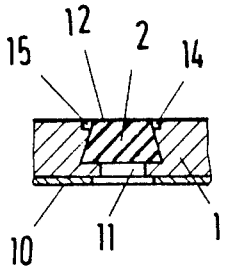

MACHINE FOR LABELLING BOTTLES

BACKGROUND OF THE INVENTION

1. Field of the Invention:

This invention relates to a bottle labelling machine and, more specifically, to a support plate for a bottle turntable in such a labelling machine which includes means for insuring that bottles secured thereon will not be subjected to undesired rotation during the labelling process.

2. Description of the Prior Art:

To label bottles in labelling machines, it is customary to support the bottles axially between the bottom and top of the bottle so that they will not rotate. The bottle should be supported within the machine against undesired rotation so that the label can be transferred to the bottle during controlled rotating movement by the machine and, after the label is applied, can be pressed completely against the surface of the bottle by applicator mechanisms, such as brushes. The precision with which this is conducted depends, among other things, on how securely the bottles can be prevented from undesired rotation. Since the controlled rotary movement is produced through frictional contact between the bottle and the bottle turntable upon which the bottle is axially supported, it is not unusual to take special precautions to keep the bottle from slipping on the turntable. The danger of slipping is particularly great, because lubricants and water are used to wet the bottle on the conveyor mechanisms, e.g. plate conveyors, upstream of the labelling machine.

To prevent the bottles from slipping on the bottle turntable, the prior art includes the use of solutions which are intended to clean the bottom of the bottle before the bottle is placed on the bottle turntable. The prior art also includes the use of solutions which are intended to clean the bottle turntable as well.

These measures can be employed as an alternative to, or in addition to, the conventional precautions taken involving the turntable itself.

For example, one prior art device utilizes a support plate for bottle turntables in which radial grooves are introduced into the surface of an elastic body of the support plate which consists of solid rubber. Since the elastic body of such a support plate does not conform to the bottom of the bottle, it is impossible to achieve a 100% frictional engagement therebetween even if the bottle is secured to the support plate by a large axial force. This is particularly true if the bottom of the bottle and/or the contact surface of the support plate is wet or has a coating of lubrication as discussed in German Utility Model DE-GM 660 77 56.

Significantly better results have been achieved with a bottle turntable in which the elastic body of a support plate mounted thereon includes an elastic coating in which sharp-edged bodies or grains are imbedded. Because of the elastic material, this support plate is capable of conforming to the shape of the bottom of the bottle. On the other hand, the sharp-edged bodies which project out of the surface under axial pressure are hooked or engaged in the microfractures on the surface of the bottom of the bottle. The increased frictional engagement achieved in this manner, when compared to other support plates of the prior art, tends to meet the basic requirements for a non-slipping coupling between the support plate and the bottle. This non-slipping condition can only be achieved, however, if the bottle is axially braced with a relatively high axial force between bottom and top. Another disadvantage of such a support plate is that it is relatively expensive to manufacture. As a practical matter, such support plates do not last long in service, because during operation, the small, hard, sharp-edged bodies or grains are easily torn from the support plate as discussed in German Patent DE 35 14 239 C1. In practice, however, it has been found that a uniform elasticity of the elastic body is only possible when the sharp-edged bodies are imbedded in the upper region. Therefore, it is not uncommon to initially form a rod of elastic material with imbedded, sharp-edged bodies evenly distributed throughout. Such a rod is then cut into discs which serve as the elastic bodies for use in the support plates on bottle turntables. Since, as a rule, these discs which serve as elastic bodies are attached with adhesive to a pot-shaped support to form the support plate, it is difficult to achieve a permanent adhesive bond between the elastic bodies and the support.

OBJECTS OF THE INVENTION

This invention relates to a bottle labelling machine including means, in the form of a support plate for a bottle turntable of the machine, for preventing undesired relative rotation of the bottle during labelling.

It is an object to provide such a support plate for bottle turntables in labelling machines, which includes an elastic body with hard material imbedded therein, which is exposed on the contact surface of the support plate.

The object of the invention is to create a support plate which lasts longer and is more economical to manufacture than those of the prior art. A greater frictional engagement is also achieved relative to the axial force required.

SUMMARY OF THE INVENTION

These and other objects are achieved in a preferred embodiment of the invention including a support plate in which several block-shaped friction bodies made of a relatively hard material are held in the elastic body of the support plate by a positive or frictional engagement.

It has been shown that such a support plate, with a comparatively low axial force, can produce a frictional engagement between the support plate and the bottom of the bottles which is better than can be achieved with the prior art configurations. The design and construction of the support plate according to the invention is simpler than that of the prior art, because the individual block-shaped friction bodies need only be cast into a single elastic material. In the prior art it was necessary either to design the support plate with a different distribution of the sharp-edged bodies or grains in the elastic material, or to cut individual discs from rod material with uniformly distributed sharp-edged grains. Since, in the present invention, only a few block-shaped friction bodies are imbedded in the elastic body, they can be deliberately anchored. This is not possible with the irregular, small bodies employed in the prior art devices. As a result, the preferred support plate is not subject to rapid wear. Finally, no high axial pressure is required, because the elastic material of the preferred support plate tends to yield easily under pressure. As a result, the axial pressure can be concentrated on the block-shaped friction bodies where it is needed because of the frictional engagement produced thereby. Since only a small quantity of the elastic material remains below the block-shaped bodies, the necessary support force and, therefore, the pressure on the block-shaped friction bodies required for the frictional engagement can be achieved in a short distance. With proper tolerances, it is possible to achieve the required support force in a short distance, while producing the pressure on the block-shaped friction bodies necessary for the frictional engagement.

According to a first configuration of the invention, the block-shaped friction bodies are oblong or elongated in shape, and are oriented radially in the elastic material. With this configuration, a wider range of diameters of the bottle can be accommodated.

To better anchor the block-shaped friction bodies in the elastic body, on the one hand, and to achieve a large support surface in the elastic material with a small contact surface on the bottom of the bottle, on the other hand, a preferred configuration for the block-shaped friction bodies of the invention is employed. The preferred friction bodies have a transverse, dovetail-shaped cross section and lie with their larger base surface in the elastic body and their smaller base surface on the upper surface of the support plate. Theoretically, it is possible to use a foam material for the elastic body. For the support plate according to the invention, however, it is desirable to use an incompressible material, preferably such as solid rubber, as the elastic material. When an incompressible material, when compared to foam material, is used, however, it is still necessary for it to experience a certain amount of yield, so that when pressure is applied to the support plate, the elastic material can yield and the friction bodies can project therefrom. Primarily for this purpose, one configuration of the invention utilizes open spaces in the surface of the elastic body at the edge of the block-shaped friction bodies. There can also be provided open spaces below the block-shaped friction bodies in the elastic body.

To be able to use identical block-shaped friction bodies in support plates having different diameters, it is appropriate for the block-shaped friction bodies to include bevelled side edges on their ends facing the center of the support plate. With this configuration for the friction bodies, even at the points of least separation, there remains sufficient elastic material between the individual block-shaped friction bodies to allow them to move independently of one another. To provide a particularly permanent connection within the support plate between the elastic material and its support, which, as a rule, is flat, one configuration of the invention includes the elastic body sitting within a flat, pot-shaped support and positively connected to the wall of the support. The positive connection can be achieved with projections or recesses, preferably holes, located in the wall of the support which are engaged by the elastic body.

To enable the bottles to be pushed onto the support plate of the bottle turntable without snagging and tipping, in another configuration of the invention, the exposed surfaces of the block-shaped friction elements or bodies lie in the plane of the surrounding exposed surface of the elastic body.

The bottle can be held by frictional engagement to prevent rotation on the turntable with a relatively low axial force if, as in another configuration of the invention, the exposed surfaces of the elastic body in the areas between the friction bodies are recessed below the exposed surfaces of the friction bodies.

This recess can preferably be provided when the support plate is manufactured by using castable material for the manufacture of the elastic body which contracts as it sets. It has been found that in the areas between the friction bodies, which consist exclusively of the elastic material, the contraction effect causes the surface to recede more severely than in the immediate vicinity of the friction bodies. Since the same effect also occurs at the outer edges of the support plate where the elastic body is reinforced by the wall of the pot-shaped support, the exposed surface at the upper side of the edge of the support plate tends to be in a common plane with the exposed surface of the friction bodies. As a result, the bottles can be pushed onto the support plate without snagging or tipping.

This invention relates to a labelling machine for a plurality of bottles comprising of an arrangement for labelling the above-mentioned bottles. One aspect of the invention resides in a bottle support platform for supporting and advancing these bottles to the above-mentioned arrangement for labelling. This bottle support platform has a plurality of bottle turntables mounted thereon. In turn, there is a support plate mounted on each of these bottle turntables to prevent relative rotation therebetween. Each of these support plates have an upper surface for receiving a bottom of one of the bottles thereon and a bottle feeding apparatus for sequentially feeding these bottles onto the upper surface of each support plate.

Another aspect of the invention involves a bottle removing device for sequentially removing the above-mentioned bottles from the upper surface of each support plate. Yet another aspect of the invention is a bottle support platform including an arrangement for selectively retaining a top of the bottle when the bottle has been positioned on the upper surface of the support plate by the bottle feeding device prior to advancement to the arrangement for labelling. This arrangement for selectively retaining the top is capable of producing an axial force between the bottom of the bottle and the upper surface of the support plate. A further aspect of the invention resides in the support plate which includes an elastic body and a plurality of block-shaped friction bodies being resiliently supported by the elastic body with each of the friction bodies being embedded and held therein. Each of the friction bodies have an exposed, friction surface which lies generally in the upper surface of the support plate.

A yet further aspect of the invention resides in the axial force producing frictional contact between the bottom of the bottle and the plurality of the friction surfaces to prevent relative rotation between one of the bottles and the bottle turntable.

DESCRIPTION OF THE DRAWINGS

One embodiment of a support plate is explained in greater detail below with reference to the accompanying drawings.

FIG. 1 shows a plan view of a support plate including various features of the invention, FIG. 2 shows the support plate as in FIG. 1, in cross section along Line II—II, FIG. 3 shows the support plate as in FIG. 1, in partial cross section along Line III—III in FIG. 1, FIG. 4 shows a plan view of a preferred block-shaped friction body of the present invention.

DESCRIPTION OF THE PREFERRED EMBODIMENT

Figure 5:
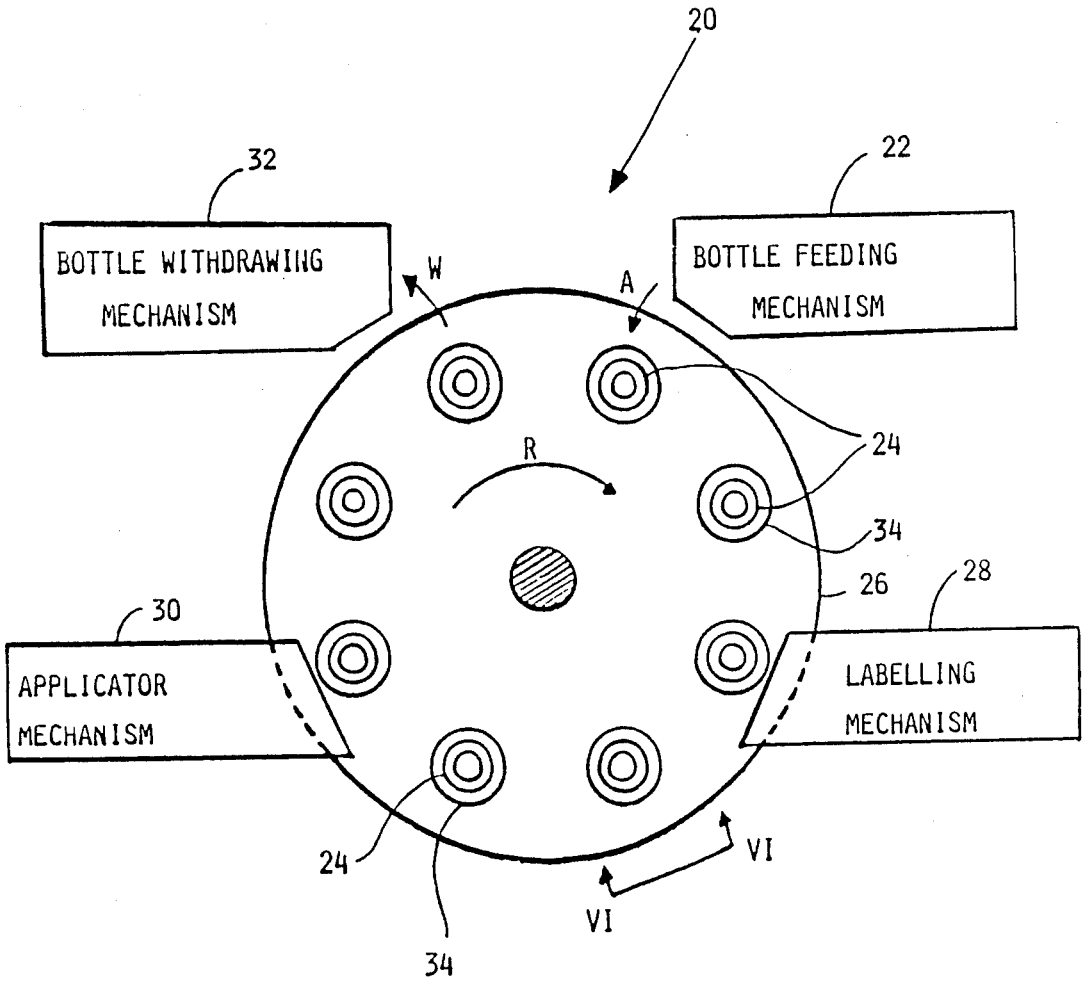
FIG. 5 shows a schematic top view of a labelling machine including various features of the invention and FIG. 6 shows a schematic view of the machine of FIG. 5 as seen along Line VI—VI.
Figure 6:
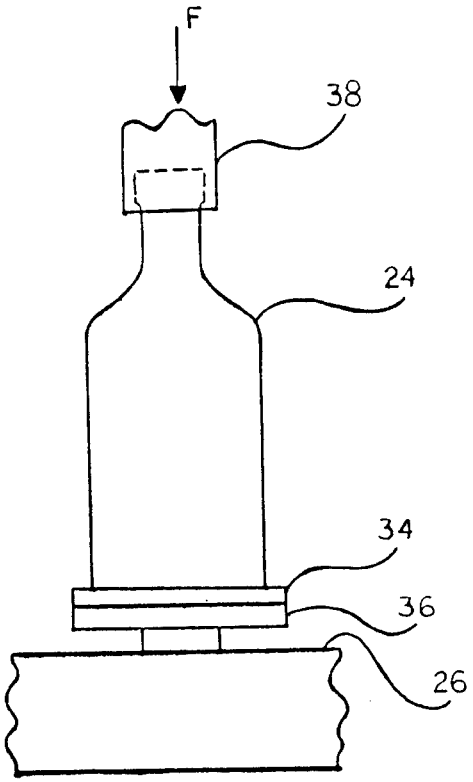

As seen in FIGS. 5 and 6, a typical labelling machine 20 is shown in schematic form. Typically, such labelling machines 20 include a bottle feeding mechanism 22 for advancing the bottles 24 as indicated by the arrow A. The bottles 24 are sequentially positioned by the bottle feeding mechanism 22 on a revolving bottle support platform 26 for advancement in a direction as indicated by the arrow R to a labelling mechanism 28. After a label is applied to the bottle 24 by the labelling mechanism 28, continued rotation of the platform 26 in the direction R advances the bottle 24 to an applicator mechanism 30 which insures that the label is properly pressed and applied to the surface of the bottle 24. Continued revolution of the bottle support platform 26 causes the bottle 24 to be directed to a bottle withdrawing mechanism 32 for removal of the bottles 24 from the revolving platform 26 as indicated by the arrow W.

As best seen in FIG. 6, each bottle 24 is initially positioned on a support plate 34 of the revolving platform 26. Specifically, the support plate 34 is mounted on a bottle turntable 36 which is adapted for controlled movement of the bottle 24 relative to the revolving platform 26. Although not shown in FIG. 5, it can be seen in FIG. 6 that, after initial positioning of the bottle 24 on the support plate 34, an upper support mechanism 38 is lowered against the top of the bottle 24 to produce a downward force F thereon as the bottle proceeds to the labelling mechanism 28 and the applicator mechanism 30. The upper support mechanism 38 is retracted prior to removal of the bottle 24 from the platform 26 at the bottle withdrawing mechanism 32.

Specifically, as will be discussed in detail hereinbelow the upper support mechanism 38 is intended to produce the axial force F on the top and the bottom of the bottle 24 to create frictional contact and to prevent undesired relative rotational movement between the bottom of the bottle 24 and the support plate 34.

The preferred support plate 34 illustrated in FIGS. 1 through 4 comprises an elastic body 1 and elongated, block-shaped, rigid friction bodies 2 imbedded in the elastic body 1 for positive engagement therebetween. The block-shaped friction bodies 2 can be manufactured of corundum material. Corundum is a mineral having $Al_3O_3$ in its chemical composition, a hardness factor of preferably about 9.0, and a density of preferably about 3.9 to 4.1 g/cm$^3$. Normal corundum as preferably diamond spar is cloudy to grey in color. The friction body 2 can also be made of a mineral mixture of corundum, magnetite, quartz, etc. This mineral mixture is used as a lubricating gel or abrasive. For example, corundum is also manufactured industrially as an abrasive and is known by the trade name AMARYL. This material or any reasonable alternative material selected for the friction bodies 2 should, as discussed in detail hereinbelow, prevent undesired slipping of the bottles on the surface of the support plate.

The elastic body 1 is supported by a flat, pot-shaped support 3. By means of a thin layer 4, the elastic material of the basic body 1 also surrounds the wall 5 of the pot-shaped support 3. Preferably, the elastic material forming the layer 4 and the remainder of the elastic body 1 is vulcanized onto the pot-shaped support 3. To achieve a better connection, the surface of the pot-shaped support 3 can be sandblasted. To improve the connection, whether the support 3 is sandblasted or not, there are included a plurality of holes 18 in the wall 5 of the pot-shaped support 3 which holes 18 are filled by the elastic material during formation of the body 1. The base 6 of the pot-shaped support 3 has, on its underside, projections 9, which are capable of being engaged in corresponding recesses (not shown) in an upper surface of the bottle turntable 36 in the labelling machine 20. In the center of the elastic body 1 and the base 6 of the support plate 34, a hole is provided for receiving a bolt (not shown) to secure the support plate 34 to the bottle turntable 36.

The friction bodies 2 are evenly dispersed around and radially oriented in the elastic body 1 of the elastic support plate 34. On the ends of the friction bodies 2 toward the center, the corners 7, 8 are bevelled. Support plates with friction bodies 2 configured in this manner may be loaded more densely than support plates with friction bodies with projecting corners. As seen in the cross sectional view of FIG. 3, the friction bodies 2 have a dovetail-shaped cross section. The larger base surface of the friction body 2 is in contact with the elastic body 1 at a relatively thin layer 10 having a central hole 11 therethrough. The smaller upper surface 12 lies in the plane of the exposed surface 13 of at least the immediately adjacent region of the elastic body 1. In this manner, an elastic support of the rigid friction body 2 is provided and, because of the relatively thin layer 10, a great deal of pressure can be producted by a short distance of compression. Because some areas of the exposed surface 13 include recesses 19 in the elastic material, it is possible, even if, as discussed hereinabove, an incompressible material is used, to cause the elastic material of the body 1 to yield as required for the elasticity. The smaller upper surface 12, on the other hand, produces a higher surface pressure on the contact regions of the bottom of the bottle 24. The dovetail shape of the friction bodies 2 ensures that the friction bodies 2 remain permanently anchored within the elastic body 1. To enable the substantially incompressible rubber material to also yield in the immediate vicinity of the friction bodies 2, the friction bodies 2 are surrounded by narrow and shallow recesses 14–17 in the surface 13 of the elastic body 1.

Since the rigid friction bodies 2 are distributed over the surface 13 of the support plate 34, the base of the bottle 24 is pressed against the smaller upper surface 12 of the friction bodies 2 at only a few locations, but with a relatively high surface pressure. Because of the thin elastic layer 10, the friction bodies 2 can yield only to accommodate specified tolerances. The compression force F necessary for the frictional engagement is therefore obtained with very little yield of the friction body 2 on the layer 10. Since the surface area of the bottom of a bottle 24 which interacts with the upper surfaces 12 of the friction bodies 2 is small, only a slight axial force is required to produce a high surface pressure. Since, in contrast to the prior art support plate which employs individually imbedded, small, sharp-edged grains or bodies, the friction bodies 2 can yield only a small amount, an effective frictional engagement is produced even though there is a low axial force. Because of the rigidity of the friction bodies 2 in the support plate 34 according to the invention, small particles will not break off the friction bodies 2, as was the case with the individual sharp-edged grains or bodies embedded in the elastic coating of the prior art devices. As a result, the service life of the preferred support plate 34 according to the present invention is longer.

Theoretically, of course, it would be possible to design the elastic body 1 with a totally planar surface. However, for a better frictional engagement between the bottom of the bottle and the friction bodies 2, it is preferable, in the areas of the elastic body 1 between the individual friction bodies 2, as shown in FIG. 2, for the exposed surface 13 to be somewhat recessed relative to the exposed upper surfaces 12 of the friction bodies 2. These recesses 19 can be easily produced during manufacture by using castable material for the elastic body 1 which contracts when it sets. In the areas of the elastic body 1 between the friction bodies 2 which are free of inserts and reinforcements, the contraction of the material is greater than in the areas immediately adjacent to the friction bodies 2 and the wall 5 of the pot-shaped support 3. The advantage of such a configuration is that the bottles can be pushed, without tipping and snagging, over the surface 13 at the peripheral regions which lie in a common plane with the upper surface 12 as they are being positioned onto the friction bodies 2.

It should be clear from the drawings and the description provided hereinabove that a preferred support plate for a bottle turntable in labelling machines includes an elastic body with a hard, friction material imbedded therein. The friction material is exposed on the support surface of the support plate and is characterized by the fact that several block-shaped friction bodies 2 made of the hard material are distributed in the rubber-elastic body 1 and are held in place by positive or frictional contact. The support plate is characterized by the fact that the block-shaped friction bodies 2 are oblong or elongated and are oriented radially in the rubber-elastic body 1. The ends of the friction bodies 2 facing the center of the support plate may have bevelled corners 7, 8. In addition, the friction bodies can have a transverse, dovetail-shaped cross section. Their larger base surface is in the elastic body 1, and their smaller base surface 12 lies on the surface of the support plate. The material of the elastic body 1 is incompressible, in particular solid rubber. There may be included open spaces 14–17 in the surface 13 of the elastic body 1 at the edge of the friction bodies 2. Additionally, there may be included open spaces 11 in the elastic body 1 under the friction bodies 2. Preferably, the elastic body 1 sits in a flat, pot-shaped support 3 and is positively connected with the wall 5 of the support 3. In one embodiment, the support plate includes, for the positive connection, the wall 5 having projections or recesses, in particular holes 18. The friction bodies may be positioned with their exposed surface 12 in the plane of the surrounding exposed surface 13 of the elastic body 1. The exposed surface 13 of the support plate may be recessed, in the areas of the elastic body 1 between the friction bodies 2, in relation to the exposed surfaces 12 of the friction bodies 2. For such a configuration, the material of the elastic body 1 is castable and contracts as it sets.

Typical bottle labelling machines include Models JOWE-9, JOWE-15, and JOWE-50 manufactured by Johann Weiss of Berlin, West Germany; the KRONES ULTRAMATIC manufactured by Hermann Kronseder of Neutraubling, West Germany; Models ALPHA 45 and ALPHA 60 manufactured by Carl Pirzer GmbH & CO. of Neutraubling, West Germany.

Additionally, bottle labelling machines are disclosed in the following U.S. Patents:

| U.S. PAT. NO. | TITLE |
|---|---|
| 4,283,245 | BOTTLE LABELLING APPARATUS |
| 4,306,926 | BOTTLE LABELING MACHINE AND METHOD |
| 4,430,141 | MACHINE FOR LABELING OBJECTS, ESPECIALLY BOTTLES |
| 4,445,961 | LABELING APPARATUS FOR BOTTLES OR THE LIKE |
| 4,512,842 | LABELING MACHINE |

All U.S. patents described or cited herein are incorporated by reference as if the documents were set forth herein in their entirety.

In summary, one aspect of the invention relates to a support plate for a bottle turntable in a labelling machine which is comprised of an elastic body and a hard material imbedded in the elastic body and exposed on the support surface of the support plate, characterized by the fact that several block-shaped friction bodies (2) made of the hard material distributed in the rubber-elastic body (1) and are held in place by positive or frictional contact.

Another aspect of the invention resides in the fact that the friction bodies (2) are oblong in shape and oriented radially in the rubber-elastic body (1).

Yet another aspect of the invention corresponds to the fact that the ends of the friction bodies (2) facing the center of the support plate have beveled corners (7,8).

A further aspect of the invention relates to the fact that in axial cross section, the friction bodies (2) have a dovetail-shaped cross sectional surface, in which their larger base surface (9) is in the elastic body (1) and their smaller base surface (12) lies on the surface of the support plate.

A yet further aspect resides in the fact that the material of the elastic body (1) is incompressible, in particular solid rubber.

Yet another further aspect of the invention corresponds to the fact that there are open spaces (13–16) in the surface (13) of the elastic body (1) at the edge of the friction bodies (2).

An additional aspect of the invention relates to fact that there are open spaces (11) in the elastic body (1) under the friction bodies (2).

A yet additional aspect of the invention corresponds to the fact that the elastic body (1) sits in a flat, pot-shaped support, and is positively connected with the wall (5) of the beam (3).

A further additional aspect of the invention resides in the fact that for the positive connection, the wall (5) has projections or recesses, in particular holes (18).

A yet further additional aspect of the invention relates to the fact that the friction bodies (2), with their exposed surface (12), lie in the plane of the surrounding exposed surface (13) of the elastic body (1).

Another further additional aspect of the invention corresponds to the fact that the exposed surface (13) of the support plate is recessed, in the areas of the elastic body (1) between the friction bodies (2), in relation to the exposed surfaces (12) of the friction bodies (2).

A yet another further aspect of the invention resides in the fact of the material of the elastic body (1) is castable and contracts as it sets.

The invention as described hereinabove in the context of a preferred embodiment is not to be taken as limited to all of the provided details thereof, since modifications and variations thereof may be made without departing from the spirit and scope of the invention.

What is claimed is:

1. A labelling machine for a plurality of bottles comprising:

means for labelling said bottles;

a bottle support platform for supporting and advancing said bottles to said means for labelling;

said bottle support platform having a plurality of bottle turntables mounted thereon;

a plurality of support plates, a said support plate mounted on each of said bottle turntables to prevent relative rotation between each of said support plates and a respective said bottle turntable;

each of said support plate shaving an upper surface for receiving a bottom of one of said bottles thereon;

bottle feeding means for sequentially feeding said bottles onto said upper surfaces;

bottle removing means for sequentially removing said bottles from said upper surfaces;

said bottle support platform including means for selectively retaining a top of a said bottle when a said bottle has been positioned on a said upper surface by said bottle feeding means prior to advancement to said means for labelling;

said means for selectively retaining a said top being capable of producing an axial force between a bottom of a said bottle and a said upper surface;

each said support plate including an elastic body;

a plurality of block-shaped friction bodies being resiliently supported by each said elastic body with each of said friction bodies being embedded and held therein;

each of said friction bodies having an exposed, friction surface which lies generally in said upper surface of each said support plate; and said axial force producing frictional contact between a bottom of a said bottle and a said plurality of said friction surfaces to prevent relative rotation between said bottles and said bottle turntables.

2. The labelling machine as set forth in claim 1, wherein each of said friction bodies has a base opposite of said friction surface, each said elastic body includes a thin layer portion aligned with each of said friction bodies and each said base is resiliently supported by a said thin layer portion of a said elastic body.

3. The labelling machine as set forth in claim 2, wherein said thin layer portions of said elastic bodies are resiliently compressed by said bases of said friction bodies as a said axial force acting upon a said bottle produces said frictional contact.

4. The labelling machine as set forth in claim 2, wherein each said base includes a peripheral surface area and each said thin layer portion below each said base is located at least at said peripheral surface area.

5. The labelling machine as set forth in claim 1, wherein each of said friction bodies is oblong and oriented radially within a said elastic body.

6. The labelling machine as set forth in claim 5, wherein each of said friction bodies includes an end disposed toward a center of a said support plate and each said end has edge corners which are bevelled.

7. The labelling machine as set forth in claim 5, wherein each of said fraction bodies includes a transverse cross section which is dovetail-shaped to include a said base having a larger surface area than a surface area of said fraction surface.

8. The labelling machine as set forth in claim 1, wherein each of said friction bodies has a base opposite of said friction surface and each of said friction bodies has at least one cross section in a plane substantially perpendicular to a said upper surface which is dove-tail-shaped to include a said base having a larger surface area than a surface area of a said friction surface.

9. The labelling machine as set forth in claim 1, wherein each said elastic body is formed of a material which is substantially incompressible when compared to a foam material.

10. The labelling machine as set forth in claim 9, wherein said material is solid rubber.

11. The labelling machine as set forth in claim 1, wherein each said elastic body includes a plurality of edges recesses in said upper surface of each said support plates adjacent a said friction surface of each of said friction bodies.

12. The labelling machine as set forth in claim 1, wherein each said support plate includes a shallow, pot-shaped support structure having a substantially cylindrical edge wall and each said elastic body is substantially located within a said support structure and is fixedly connected to a said edge wall.

13. The labelling machine as set forth in claim 12, wherein each said edge wall includes radially extending surfaces and each said elastic body includes portions thereof in overlapping, engaging contact with said radially extending surfaces.

14. The labelling machine as set forth in claim 13, wherein said radially extending surfaces of each said edge wall are defined by at least one radially extending hole through said edge wall.

15. The labelling machine as set forth in claim 1, wherein said friction surface of said friction bodies lie in a substantially common plane to define an upper limit of said upper surface of each said support plate, said upper surface of each said support plate includes regions thereof generally surrounding said friction surfaces, said elastic bodies are located in said regions, and said regions lie in said common plane.

16. The labelling machine as set forth in claim 15, wherein said upper surface of each said support plate includes peripheral regions of said upper surface, said elastic bodies are located in said peripheral regions, and said peripheral regions substantially lie in said common plane.

17. The labelling machine as set forth in claim 16, wherein said upper surface of each said support plate is recessed in areas of said elastic body between said friction bodies to be below said common plane.

18. The labelling machine as set forth in claim 17, wherein each said elastic body is formed of castable material, said castable material contracting to form said elastic body.

* * * * *

UNITED STATES PATENT AND TRADEMARK OFFICE

CERTIFICATE OF CORRECTION

PATENT NO. : 4,944,830

DATED : July 31, 1990

INVENTOR(S) : Rudolf ZODROW, et al.

It is certified that error appears in the above-identified patent and that said Letters Patent is hereby corrected as shown below:

Title page:

Under the Assignee section, indicated by the INID code [73], please delete "Holstein und Kappert, AG" and insert --ETI-TEC Maschinenbau GmbH--

Under the Assignee section, indicated by the INID code [73], please delete "Dortmund, Fed. Rep. of Germany" and insert --Erkrath, Federal Republic of Germany--.

In column 9, line 15, please delete "plate shaving" and insert --plates having--

In column 10, line 4, please delete "fraction" and insert --friction--

Signed and Sealed this

Twenty-first Day of January, 1992

*Attest:*

HARRY F. MANBECK, JR.

*Attesting Officer*

*Commissioner of Patents and Trademarks*